United States Patent [19]

Ellis

[11] Patent Number: 4,995,115

[45] Date of Patent: Feb. 26, 1991

[54] GARMENT FOR A WHEELCHAIR OCCUPANT

[76] Inventor: Janice Ellis, 1221 Morton Ave., Aurora, Ill. 60506

[21] Appl. No.: 491,722

[22] Filed: Mar. 12, 1990

[51] Int. Cl.[5] ..... A41D 13/12; A41D 27/10; A41D 10/00

[52] U.S. Cl. ..... 2/69; 2/114; 2/69.5; 2/269; 2/270; 2/125; 2/DIG. 7

[58] Field of Search ..... 2/69, 114, DIG. 7, 69.5, 2/70, 71, 72, 73, 269, 270, 125, 126

[56] References Cited

U.S. PATENT DOCUMENTS

| | | | |
|---|---|---|---|
| 237,096 | 2/1881 | Delmonte | 2/269 |
| 1,489,046 | 11/1921 | Thompson | 2/DIG. 7 |
| 1,593,027 | 7/1926 | Montague | 2/269 |
| 1,626,024 | 2/1926 | Crane | 2/71 |
| 2,374,643 | 10/1942 | Boettcher | 2/DIG. 7 |
| 3,276,036 | 3/1964 | Cater | 2/114 |
| 3,490,072 | 8/1967 | Keltner | 2/114 |
| 4,258,440 | 3/1981 | McGowan | 2/DIG. 7 |
| 4,764,985 | 8/1988 | Wade | 2/114 |
| 4,787,101 | 11/1988 | Feinberg | 2/114 |
| 4,837,863 | 6/1989 | Van Scoy-Mosher | 2/DIG. 7 |

FOREIGN PATENT DOCUMENTS

| | | | |
|---|---|---|---|
| 2544594 | 10/1984 | France | 2/DIG. 7 |
| 8900822 | 2/1989 | PCT Int'l Appl. | 2/DIG. 7 |

*Primary Examiner*—Werner H. Schroeder
*Assistant Examiner*—Gloria Hale
*Attorney, Agent, or Firm*—Douglas B. White

[57] ABSTRACT

Generally there is provided a gown-like garment for covering the body, legs and arms of a person which has closable openings along the sides to define a front and back panel thereto. The rear panel is arranged to fold upwardly and attach along the wearer's back to secure the panel out of the way. The front panel lays across the wearer's lap to maintain a lap covering. In additional features the sleeves are provided with closable openings to allow access for intravenous apparatus and the extremity of the sleeve is provided with tabs for attaching it to the gown to store it out of the way when opened for access to the patient's arm and to selectively tighten the sleeve.

8 Claims, 2 Drawing Sheets

GARMENT FOR A WHEELCHAIR OCCUPANT

BACKGROUND OF THE INVENTION

1. Field of the Invention

This invention relates generally to gown-like garments designed for persons occupying wheelchairs. More particularly this invention relates to a garment which may be selectively modified when the wearer desires to sit in the wheelchair by allowing a rear panel to be moved out of the way to prevent uncomfortable bunching under the person, and by allowing opening, tightening and storage of the sleeve.

2. Description of the Prior Art

Prior robes and gowns for convalescents have been directed toward a myriad of safety and comfort concerns. In U.S. Pat. No. 4,787,101 there is described a gown designed to function with a restraining device. In U.S. Pat. No. 4,422,186 there is shown a gown with closable slits extending from the collar down the sleeves to facilitate intravenous apparatus. In U.S. Pat. No. 4,764,985 there is shwon a poncho-type garment having a narrowed back portion to conform to the chair. U.S. Pat. No. 4,837,863 shows a back panel with overlapping inner and outer panels. Finally, in the U.S. Pat. No. 459,106 there is depicted a gown for an invalid which has a removable rear panel for cleaning purposes. None of these prior designs improve the comfort of the wheelchair patient by allowing selective adjustment of the garment to move and secure the back panel. Moreover, none of these references show such adjustment in conjunction with sleeve convenience features.

SUMMARY OF THE INVENTION

It is principal object of the present invention to improve the gown-like garments worn by wheelchair patients to make them more functional and comfortable by providing means for holding a back panel portion out of the way when the wearer is in the seated position. It is additionally an object to provide sleeve opening features and other convenience features in conjunction with such a garment.

Generally there is provided a gown-like garment for covering the body, legs and arms of a person which has closable openings along the sides to define a front and rear panel thereto. The rear panel is arranged to fold upwardly and attach along the wearers back to secure the panel out of the way. The front panel lays across the wearers lay when seated to maintain a lap covering. In additional features, the sleeves are provided with closable openings to allow access for intravenous apparatus and the extremity of the sleeve is provided with means for ajusting the fit and for attaching the sleeves to the gown to keep the loose sleeves out of the way when opened for access to the patients arm.

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

DESCRIPTION OF THE PREFERRED EMBODIMENT

Figure 2:
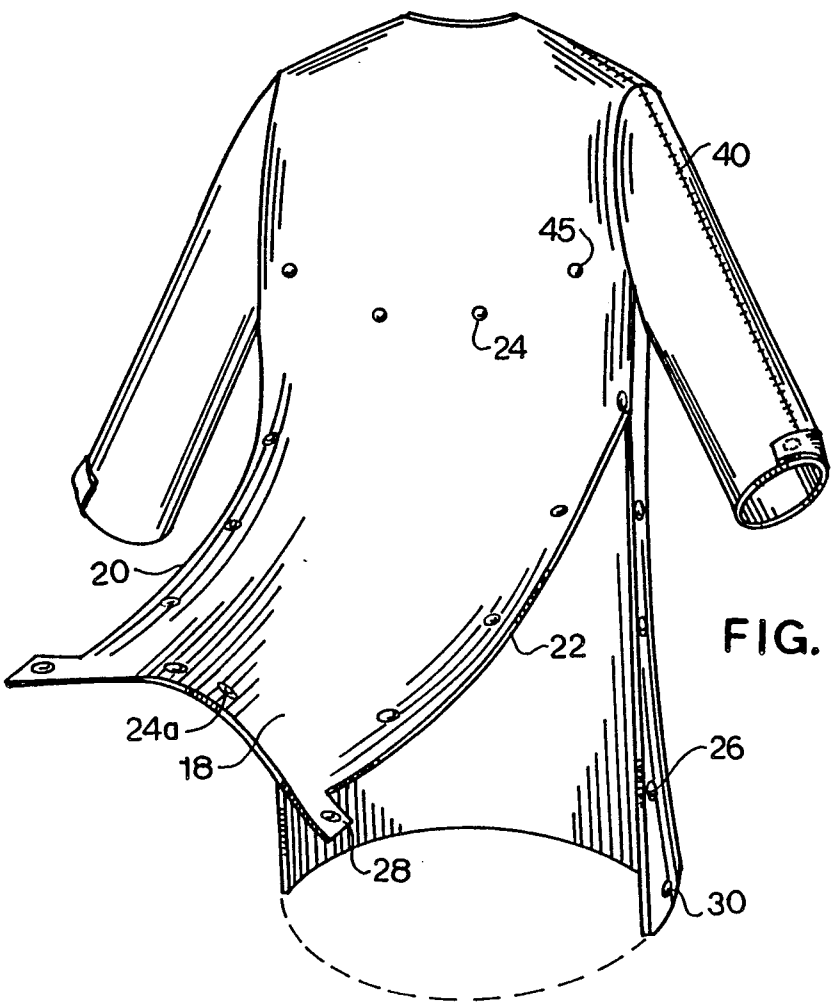
FIG. 2 is a rear perspective view of the gown of the present invention showing the rear panel thereof.
Figure 1:
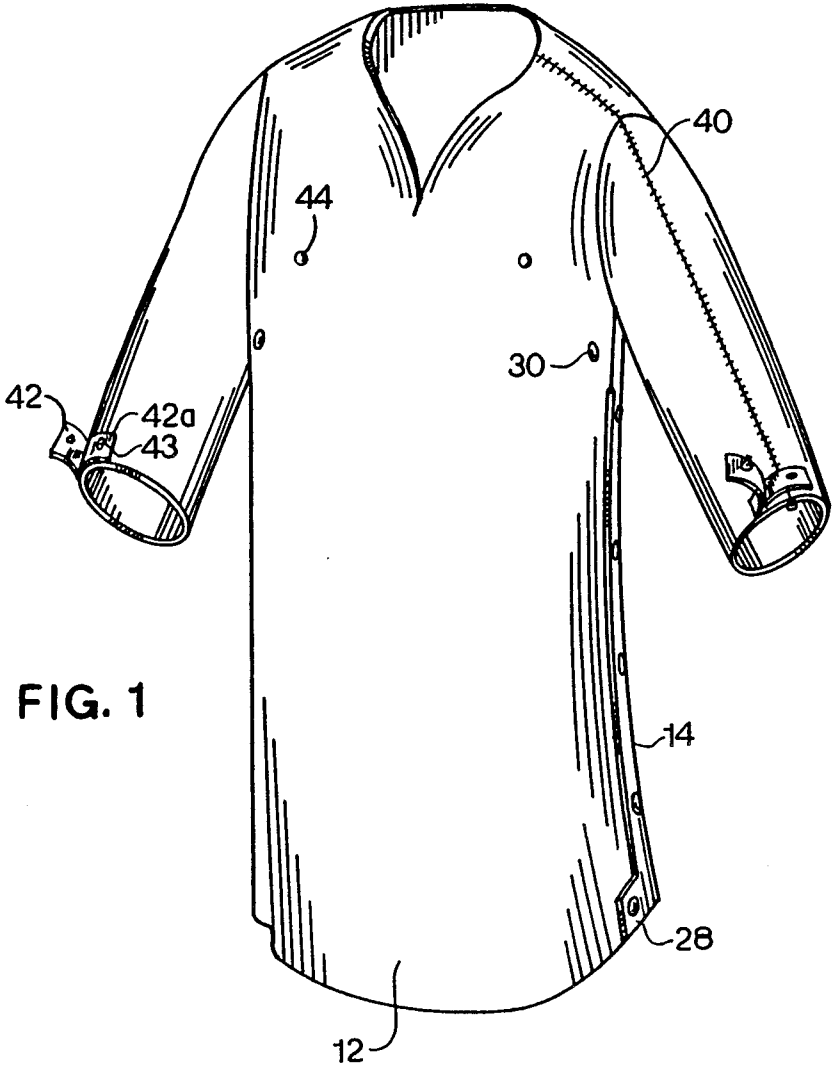
FIG. 1 is a front perspective view of the gown of the present invention.

Turning first to FIG. 1 there is shown, in perspective, the front and left side of a gown-like garment in accordance with the present invention. FIG. 2 depicts in perspective, the rear and right side of the garment. This garment is constructed to define a front portion 12 and a rear portion 14. (While a particular collar design has been chosen for illustration, the invention is not to be limited to any specific style.)

In a principal feature of the present invention there is provided a rear panel 18 releasably secured along its sides 20 and 22 to the front portion of the garment. A double ply, or any other construction techniques known in the industry, may be employed in the construction of the garment and particularly the rear panel. This rear panel folds upwardly (as shown in FIG. 2) behind the wearer and is secured to fasteners 24 at the back of the garment with fasteners **24*a*** along the lower edge of the panel. These fasteners, positioned along the sides of the garment, at the back of the garment, and generally described throughout this description may be hook/-loop fasteners (Velcro), snaps, buttons, or any other equivalent means known in the industry.

When the rear panel is in the lowered position, the side fasteners 26 are used to secure the rear panel edge to the edge of the front portion of the garment. Moreover, side tabs 28 at the lower end of each side of the rear panel attach to fasteners 30 forward of the side to maintain the lower line of the garment. When the rear panel is lifted, these tabs 28 function to secure the panel to fasteners 30 on the front of the garment to keep the edge of the rear panel straight behind the wearer. Accordingly, when the person is seated, as in a wheelchair, this rear panel is kept comfortably out of the way.

In a further feature of this garment, there is provided closable openings 40 extending from the collar down the sleeve. This access may be zippered, opening from either end, or closed with other fastener means known in the art. When access is needed for intravenous apparatus, the sleeve is conveniently opened.

Figure 3:
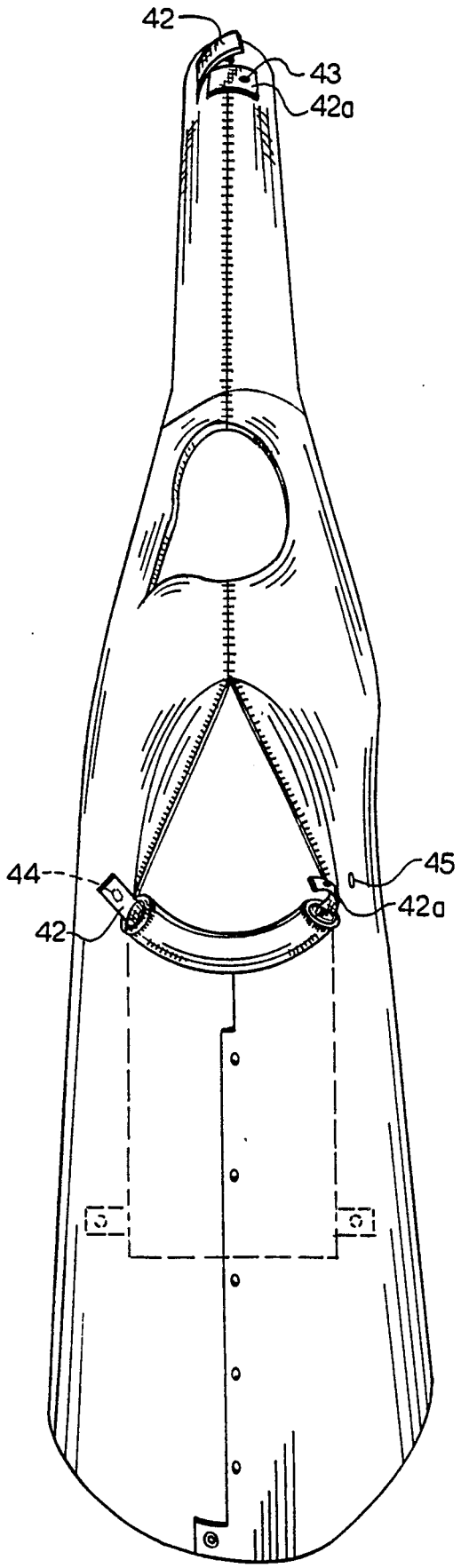
FIG. 3 is a side view of the gown showing the functions of the sleeve features.

In the event the end of the sleeve is open, fastener strips 42 and **42*a* are used to secure the sleeve to the body of the garment at front fasteners 44 and rear fasteners 45. Particularly, the sleeve may be rolled up, allowing the strips to protrude from the roll, and then securing the roll via the strips. Additionally, the sleeve fastener strips are attached to the sleeve only along one short edge. To tighten the sleeve, the strips are overlapped and underside fastener 43 on one of the strips is used, to secure one to the other (as shown in FIG. 3**).

From the foregoing description, it will be apparent that modifications can be made to the apparatus and method for using same without departing from the teachings of the present invention. Accordingly, the scope of the invention is only to be limited as necessitated by the accompanying claims.

I claim:

1. A garment for wear by a person while occupying a wheelchair, said garment comprising:

gown apparel including a body portion and sleeve portions, said gown further comprising selectively closable slits positioned along each side of said gown and thereby defining a back panel thereto moveable between an upper and lower position; and means for fastening the lower edge of said back panel to the back of said gown when saaid back panel is raised to said upper position.

2. The garment of claim 1 further comprising selectively closable openings along the sleeve portions thereof.

3. The garment of claim 2 wherein said sleeve portions are selectively closable along their length, and further comprising dual strips affixed proximate the extremity of said sleeves for fastening said opened sleeve to said gown body for storage thereof.

4. The garment of claim 3 wherein said tabs further comprise means for securing one to the other for tightening the sleeve opening.

5. The garment of claim 1 further comprising side tabs integral with the lower extremity of said back panel for securing said lower edge to the front of the gown when said panel is in either said upper or lower position.

6. The garment of claim 5 further comprising selectively closable openings along the sleeve portions thereof.

7. The garment of claim 6 wherein said sleeve portions are selectively closable along their length, and further comprising dual strips affixed proximate the extremity of said sleeves for fastening said opened sleeve to said gown body for storage thereof.

8. The garment of claim 7 wherein said tabs further comprise means for securing one to the other for tightening the sleeve opening.

* * * * *